US007488197B2

(12) United States Patent
Shinozaki

(10) Patent No.: US 7,488,197 B2
(45) Date of Patent: Feb. 10, 2009

(54) CONNECTOR, A CONNECTOR ASSEMBLY AND AN ASSEMBLING METHOD THEREFOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/879,816

(22) Filed: Jul. 19, 2007

(65) Prior Publication Data

US 2008/0020630 A1 Jan. 24, 2008

(30) Foreign Application Priority Data

Jul. 21, 2006 (JP) ..... 2006-199547

(51) Int. Cl.
*H01R 3/00* (2006.01)

(52) U.S. Cl. ..... 439/489

(58) Field of Classification Search ..... 439/489, 439/488, 354, 352, 79, 188
See application file for complete search history.

(56) References Cited

U.S. PATENT DOCUMENTS 5,562,486 A * 10/1996 Saijo et al. ..... 439/489
5,863,216 A * 1/1999 Tsuji et al. ..... 439/489
6,045,395 A * 4/2000 Saito et al. ..... 439/489

* cited by examiner

*Primary Examiner*—Alexander Gilman
(74) *Attorney, Agent, or Firm*—Gerald E Hespos; Anthony J. Casella

(57) ABSTRACT

A circuit board connector housing (10) includes slide contacts (19) arranged before contact areas (16) of detecting terminals (15A) with respect to a connecting direction. The slide contacts (19) contact touching portions (30) of shorting terminals (27) during a connecting operation of two housings (10, 20). The slide contacts (19) remove foreign matter from the touching portions (30) during the connecting operation of the two housings (10, 20). Thus, extra efforts to remove foreign matter are not needed before the housings (10, 20) are connected. The absence of foreign matter on the touching portions (30) achieves good quality contact with the contact areas (16) of the detecting terminals (15A) and assures reliability of a connection detecting function.

11 Claims, 8 Drawing Sheets

CONNECTOR, A CONNECTOR ASSEMBLY AND AN ASSEMBLING METHOD THEREFOR

BACKGROUND OF THE INVENTION

1. Field of the Invention

The invention relates to a connector with a connection detecting function and to an assembling method therefor.

2. Description of the Related Art

U.S. Pat. No. 5,863,216 discloses a connector with a connection detecting function. The connector has first and second housings that connectable with each other. The first housing has a resilient lock arm that deforms down in the process of connecting the two housings. However, the lock arm restores resiliently to engage the second housing when the housings reach a properly connected state. A first detecting terminal is provided below the lock arm. The first detecting terminal is pressed down and deformed by the lock arm upon connecting the two housings. However, the first detecting terminal restores resiliently as the lock arm resiliently restores to free the first detecting terminal from the pressed state.

The second housing includes a second detecting terminal that is inserted into the first housing as the housings are connected. The lock arm presses and deforms the first detecting terminal second detecting terminal in a partly connected state of the two housings. Thus, the second connecting terminal is unable to contact a touching portion of the first detecting terminal because. However, the lock arm no longer presses the first detecting terminal when the housings are connected properly. As a result, the first detecting terminal is restored resiliently, and the second detecting terminal can contact the touching portion of the first detecting terminal in the properly connected state of the two housings.

The partly connected state of the two housings is detected by the absence of contact between the first and second detecting terminals and the properly connected state of the two housings is detected by the electrical connection between the first and second detecting terminals.

Foreign matter can attach to the outer surface of the first detecting terminal due to oil used during press working and can hinder the electrical connection between the second detecting terminal and the touching portion. The absence of a connection signal would be interpreted as an improper connection even though the housings may be connected properly, thereby reducing the reliability of the connection detecting function. Foreign matter may be removed from the touching portion before the housings are connected to improve detection reliability. However, removing the foreign matter takes a very long time and is cumbersome. Thus, operational efficiency is poor.

The invention was developed in view of the above and object thereof is to provide a connector with improved operational efficiency.

SUMMARY OF THE INVENTION

The invention relates to a connector with a housing that is connectable with a mating housing. A detecting terminal is provided in the housing and cannot contact a touching portion of a mating detecting terminal in the mating housing while the housings are in a partly connected state. However, the detecting terminal can contact the touching portion when the housings are connected properly. Thus, partial connection of the housings can be detected by the absence of an electrical connection between the detecting terminal and the mating detecting terminal, and proper connection of the housings can be detected by the establishment of an electrical connection between the detecting terminal and the mating detecting terminal. At least one slide contact portion is provided in the housing before a contact portion of the detecting terminal with respect to forward and backward directions. The slide contact portion can slide in contact with the touching portion of the mating detecting terminal during a connecting operation of the housings.

The slide contact portion preferably projects more towards the touching portion than the contact portion of the detecting terminal.

At least one reinforcing rib preferably is formed in the housing close to the detecting terminal. The reinforcing rib projects more forward than the detecting terminal along a forward and backward direction. The reinforcing rib preferably includes a substantially flat plate that extends substantially along the detecting terminal, at least one first wall that projects from the flat plate on the side of the detecting terminal, and at least one second wall that projects from the flat plate on a side substantially opposite to the detecting terminal.

The slide contact preferably is on the reinforcing rib.

The invention also relates to a connector assembly comprising the above-described housing and the mating housing that are connectable with each other.

A lock arm preferably is provided on the mating housing and is deformed as the two housings are being connected. The lock arm then restores resiliently when the two housings reach a properly connected state and locks the two housings together. The lock arm presses and deforms the mating detecting terminal when the lock arm is deformed during the connecting operation. However, the lock arm resiliently restores when the housings are connected properly, and the restored lock arm frees the mating detecting terminal from the pressed state. The detecting terminal cannot contact the touching portion of the mating detecting terminal in the partly connected state of the two housings because the deformed lock arm presses and deforms the mating detecting terminal. However, the lock arm stops pressing the mating detecting terminal when the housings are connected properly and therefore the detecting terminal can contact the touching portion.

The slide contact preferably is arranged to contact the touching portion before the lock arm presses the detecting terminal in the process of connecting the two housings.

The invention also relates to a method of assembling a connector assembly. The method comprises moving a first housing that has a first detecting terminal towards connection with a second housing that has a second detecting terminal. The method further includes sliding a portion of the housing against the second detecting terminal as the housings are moved towards connection for removing any foreign matter from the second detecting terminal. The method also includes deflecting the second detecting terminal into a position for preventing contact with the first detecting terminal as the housings move towards connection. The method then includes permitting the second detecting terminal to restore resiliently into contact with the first detecting terminal when the housings are connected properly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector assembly in accordance with the invention is illustrated in FIGS. 1 to 8. The connector assembly includes a circuit board housing 10 and female housings 20 that are connectable with the circuit board housing 10. The circuit board housing 10 is connected with a circuit board or other electric or electronic equipment, such as an electrical junction box, a display device, or a panel instrument. Ends of the housings 10, 20 that are to be connected along forward and backward directions FBD are referred to as the front ends, and upper and lower sides refer to the orientation in FIG. 1.

Figure 2:
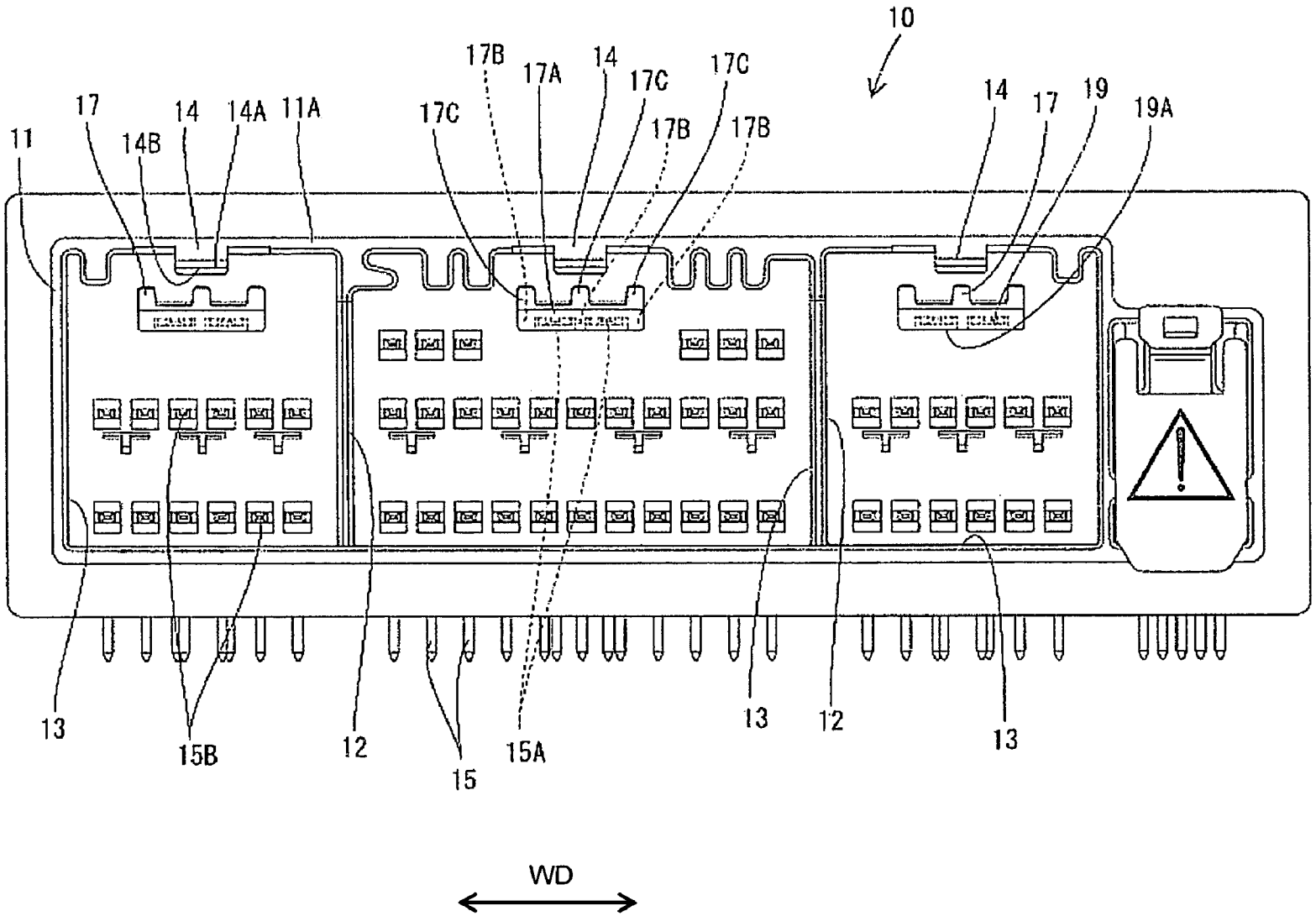
FIG. 2 is a front view of the circuit board connector housing.
Figure 3:
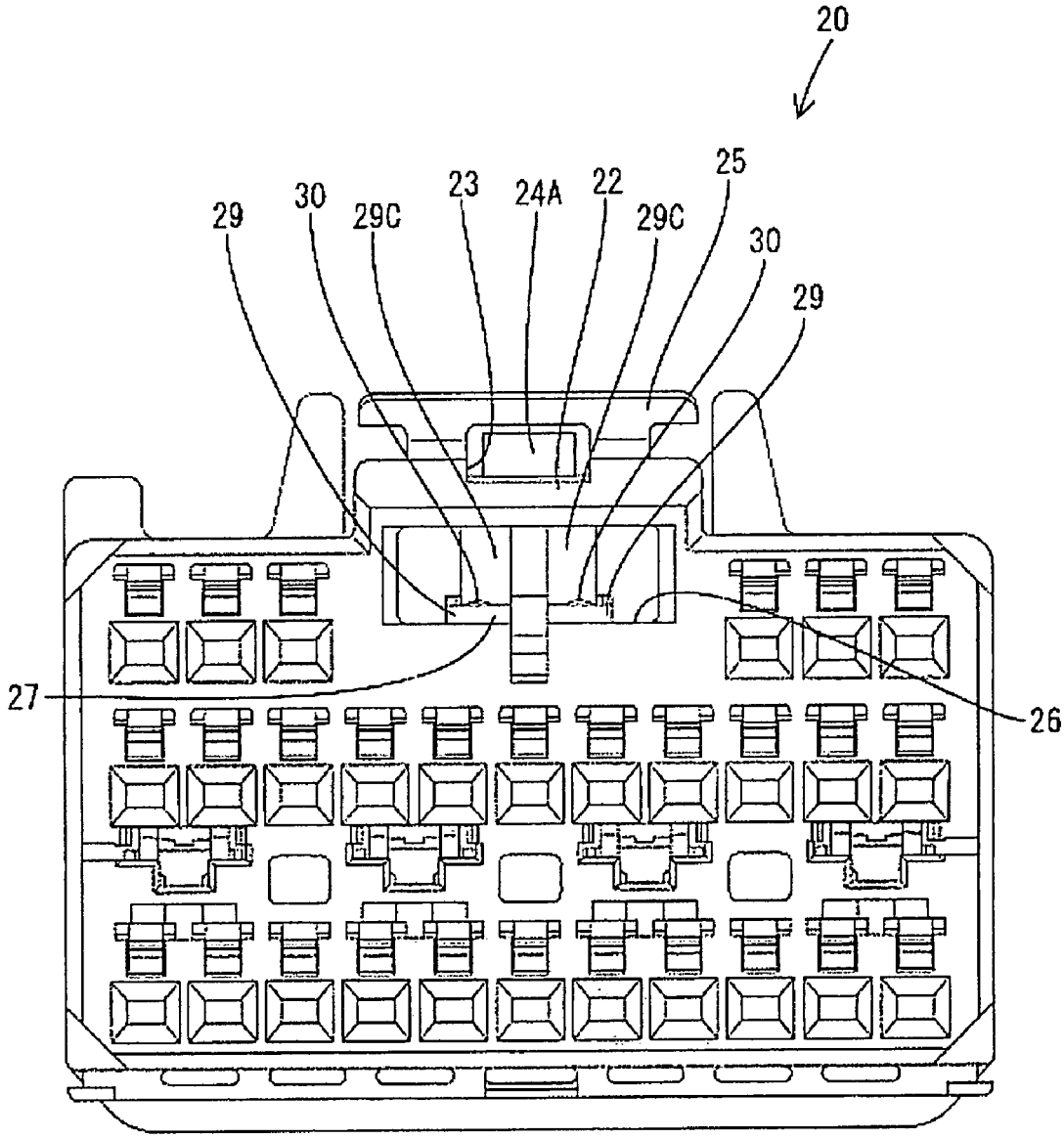
FIG. 3 is a front view of the female connector housing.
Figure 4:
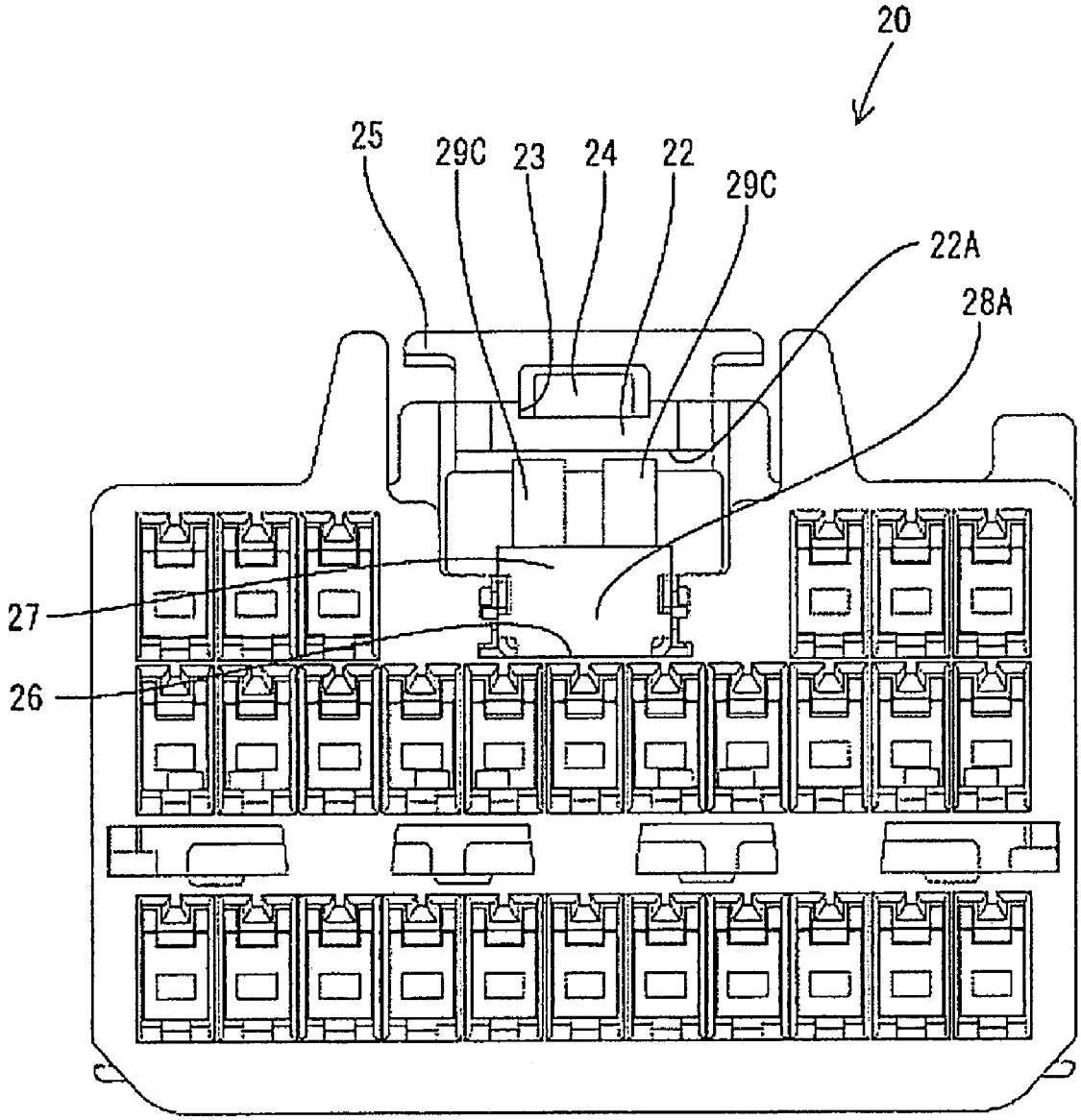
FIG. 4 is a rear view of the female connector housing.

The circuit board housing 10 includes a receptacle 11 having an open front end. Two partition walls 12 are spaced apart in the width direction WD inside the receptacle 11 and divide the receptacle 11 into three divided housings 13, as shown in FIG. 2. Three separate female connector housings 20 can be fit respectively into the three divided housings 13.

Figure 1:
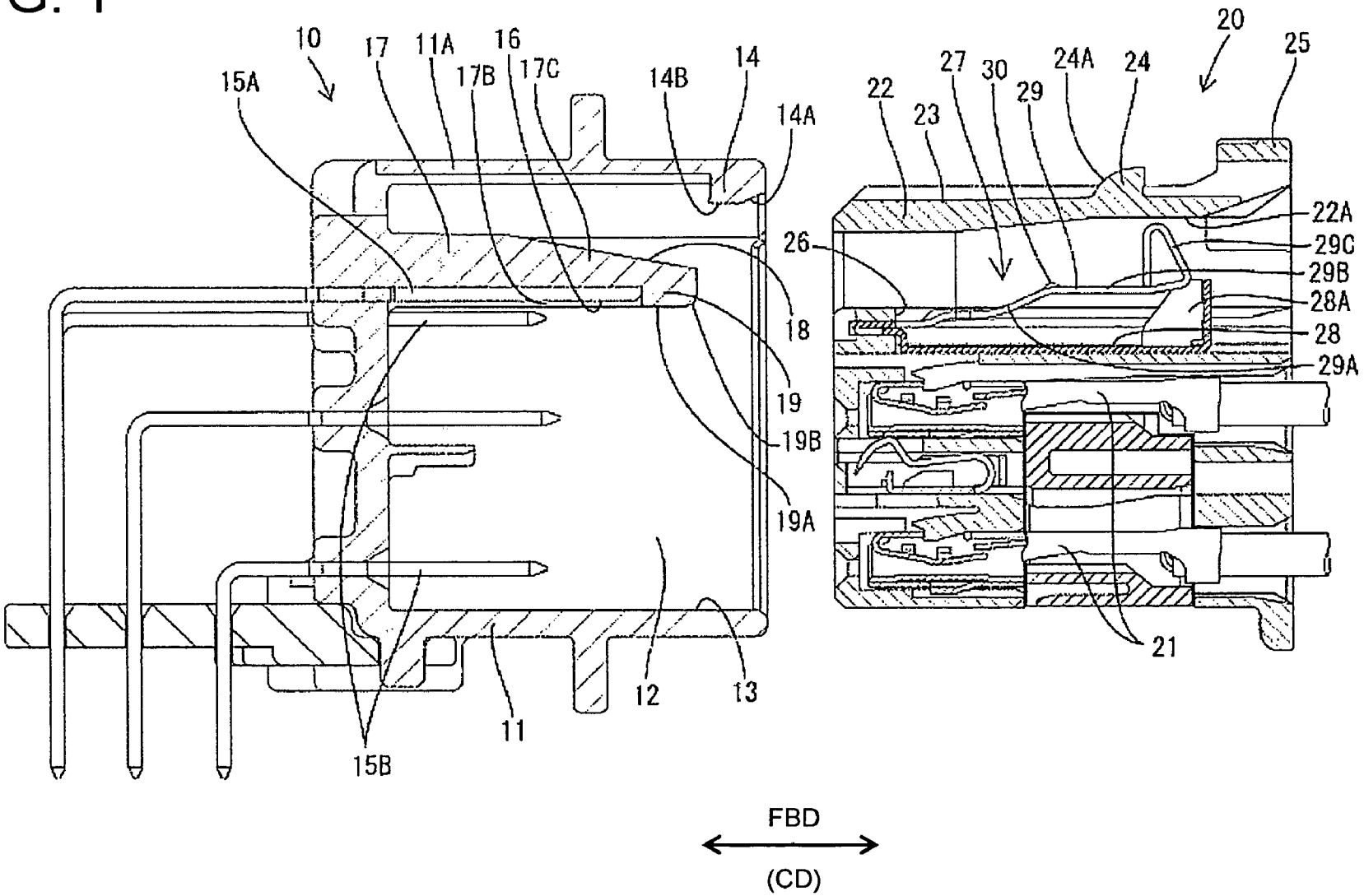
FIG. 1 is a side view in section showing a state before a circuit board connector housing and a female connector housing according to one embodiment are connected.

An engaging portion 14 projects down and in from a ceiling wall 11A of each divided housing 13 of the receptacle 11 and is engageable with a lock arm 22 of the respective female housing 20. A slanted surface 14A is defined at a front part of the inner surface of each engaging portion 14 and gradually slopes down and towards the back. A substantially horizontal surface 14B extends substantially parallel to the ceiling wall 11A and to the forward and backward directions FBD, as shown in FIG. 1, along a rear half of the engaging portion 14.

Two detecting terminals 15A and a plurality of male terminals 15B are bent in L-shape and are mounted in the circuit board housing 10 so that leading ends project into the receptacle 11. The detecting terminals 15 are at uppermost positions in each divided housing 13 and project forward beyond a substantially middle position of the receptacle 11 in forward and backward directions FBD. The projecting ends of the detecting terminals 15A are more forward than the projecting ends of the male terminals 15B. Contact areas 16 are defined on portions of the lower surfaces of the detecting terminals 15A that project more forward than the male terminals 15B.

A reinforcing rib 17 is provided above each pair of detecting terminals 15A. The reinforcing rib 17 projects more forward than the detecting terminals 15A and includes a substantially flat plate 17A that extends along the upper surfaces of the detecting terminals 15A. Three lower walls 17B hang down from the lower surface of the flat plate 17A, and three upper walls 17C project up from the upper surface of the flat plate 17A, as shown in FIG. 2. The upper and lower walls 17C and 17B extend over substantially the entire length of the flat plate 17A in forward and backward directions FBD.

The lower walls 17B are arranged between the two detecting terminals 15A and at the outer sides of the detecting terminals 15A, and lower surfaces of the lower walls 17B are lower than the lower surfaces of the detecting terminals 15A. The lower wall 17B between the pair of detecting terminals 15A partitions the detecting terminals 15A, and the lower walls 17B at the opposite outer sides cover the lateral sides of the detecting terminals 15A.

The upper walls 17C are arranged at positions corresponding to the three lower walls 17B. Escaping surfaces 18 are defined on the front parts of the upper surfaces of the upper walls 17C and gradually slope down and in towards the front. Rear portions of the upper walls 17C have a substantially equal height in forward and backward directions FBD. Thus, clearances between the ceiling wall 11A of the receptacle 11 and the upper walls 17C are gradually narrowed from the front ends toward the intermediate positions, and extend from the intermediate positions with a substantially constant height.

The detecting terminals 15A are inserted into the circuit board housing 10 along the lower surface of the reinforcing rib 17 to prevent upward warping. The upper and lower walls 17C and 17B make the reinforcing rib 17 rigid and prevent the reinforcing rib 17 from deforming up in response to any warping tendency of the detecting terminals 15A. A slide contact 19 is held at a specified position without shaking up and down.

The three female housings 20 are of similar construction and can fit respectively into the divided housings 13. The illustrated female housing 20 is intended to be fit into the divided housing 13 in the intermediate position.

Each female housing 20 is substantially block-shaped and has female terminal fittings 21 that are connectable with the male terminals 15B.

A resilient lock arm 22 is cantilevered back from the front of the upper surface of each female housing 20, as shown in FIG. 1, and is deformed as the female housing 20 is connected with the circuit board housing 10. The lock arm 22 restores resiliently when the two housings 10, 20 reach a properly connected state for locking the housings 10, 20 together.

A recess 23 is defined in a widthwise intermediate part of the upper surface of each lock arm 22 and extends over substantially the entire length in forward and backward directions FBD. The recess 23 has a width to permit passage of the corresponding engaging portion 14 of the receptacle 11. A projection 24 projects upward at a position near the rear end of the recess 23 and is engageable with the engaging portion 14 of the receptacle 11. A moderately sloped surface 24A is formed at the front of each projection 24.

An pressing surface 22*a* is defined on the lower surface of the lock arm 22 rearward of the projection 24.

An operable portion 25 is provided at the rear end of the lock arm 22. The operable portion 25 is pressed to deform the lock arm 22 down. Thus, the projection 24 and the engaging portion 14 disengage so that the housings 10, 20 can be separated.

A terminal accommodating portion 26 is provided below each lock arm 22 for accommodating the shorting terminal 27. The floor surface of each terminal accommodating portion 26 is substantially flat.

Figure 5:
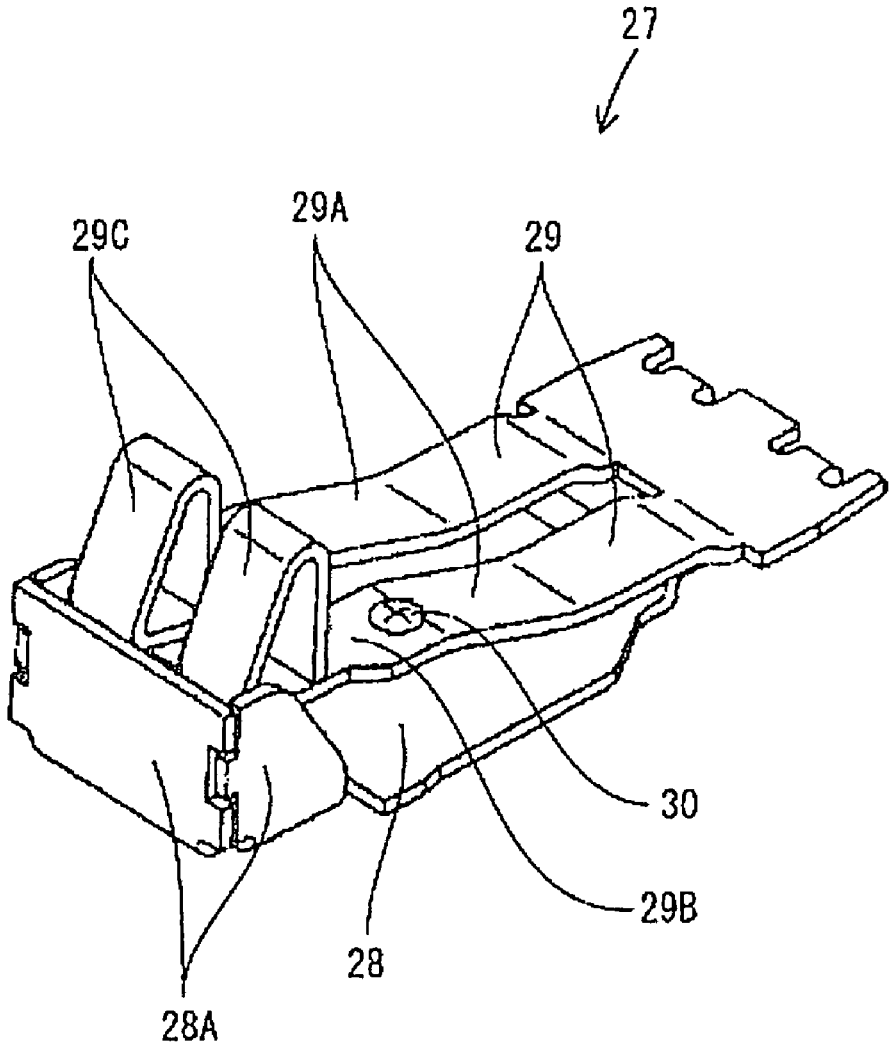
FIG. 5 is a perspective view of a shorting terminal.

The shorting terminal 27 accommodated in each terminal accommodating portion 26 is formed by bending, folding and/or embossing an electrically conductive metal plate punched or cut out into a specified shape. The shorting terminal includes a substantially planar base 28 and two resilient contact pieces 29 extending back from the front end of the base 28, as shown in FIGS. 1 and 5. The base 28 enables each shorting terminal 27 to be accommodated in a stable posture in the terminal accommodating portion 26.

A protection wall 28A projects substantially perpendicularly up from the base 28 at positions adjacent the left, right and rear edges of the base portion 28. The protection wall 28A impedes the entrance of foreign matter through the rear opening of the female housing 20.

Two resilient contact pieces 29 cantilever forward on the shorting terminal and have inclined portions 29A at intermediate positions in forward and backward directions FBD. The inclined portions 29A gradually incline up and out towards the back. Substantially horizontal portions 29B are formed behind the inclined portions 29A and extend substantially parallel to the base 28 and to the forward and backward directions FBD. A pressable portion 29C is bent into a substantially triangular shape to project out and up at the free rear end of each resilient contact piece 29 and at the rear end of the respective horizontal portions 29B. The pressable portions 29C project up beyond the protection wall 28A in the unbiased condition of the respective resilient contact piece, but become hidden inside the protection wall 28A when pressed by the pressing surface 22A of the lock arm 22.

A touching portion 30 is provided at a boundary between the inclined portion 29A and the horizontal portion 29B in each resilient contact piece 29. The respective touching portions 30 are substantially dome-shaped projections formed in widthwise intermediate positions of the corresponding resilient contact pieces 29.

The slide contact 19 at the leading end of each reinforcing rib 17 of the circuit board housing 10 and can slide in contact with the touching portions 30 during the connecting operation of the two housings 10, 20. Each slide contact 19 is right before the contact areas 16 at the projecting ends of the detecting terminals 15A. The slide contact 19 projects down from the lower surface of the flat plate 17A and has substantially the same projecting distance as the lower walls 17B, and projects farther down than the contact areas 16 of the detecting terminals 15A. Each slide contact 19 is formed over substantially the entire width of the front end edge of the corresponding flat plate 17A, and connects the front ends of the lower walls 17B in the width direction WD to cover the front ends of the contact areas 16.

A slide contact surface 19A is defined at the lower surface of each slide contact 19 and can slide in contact with the corresponding touching portions 30. The slide contact surface 19A is lower than the lower surfaces of the contact areas 16. The respective slide contact surfaces 19A are substantially parallel to an extending direction of the reinforcing ribs 17 (direction parallel to a connecting direction CD of the two connector housings 10, 20). Further, a rounded corner 19B is formed at the bottom front of the respective slide contact 19.

The height of the slide contact surface 19A of each slide contact 19 corresponds to intermediate positions in forward and backward directions FBD of the inclined portions 29A of the resilient contact pieces 29 of each shorting terminal 27 accommodated in a natural state in the female housing 20, and hence is slightly lower than the touching portions 30 when the two housings 10, 20 are connected.

The female housings 20 are fit into the corresponding divided housings 13 of the circuit board housing 10. As a result, the lock arm 22 is inserted along the ceiling wall 11A of the receptacle 11 and the engaging portion 14 of the receptacle 11 passes along the recess 23 of the lock arm 22. Intermediate parts in forward and backward directions FBD of the inclined portions 29A of the resilient contact pieces 29 of the shorting terminal 27 contact the rounded corner 19B of the slide contact 19. Thus, the slide contact 19 presses the resilient contact pieces 29 and deforms the resilient contact pieces 29 down and in as the female housing 20 is pushed further.

Figure 6:
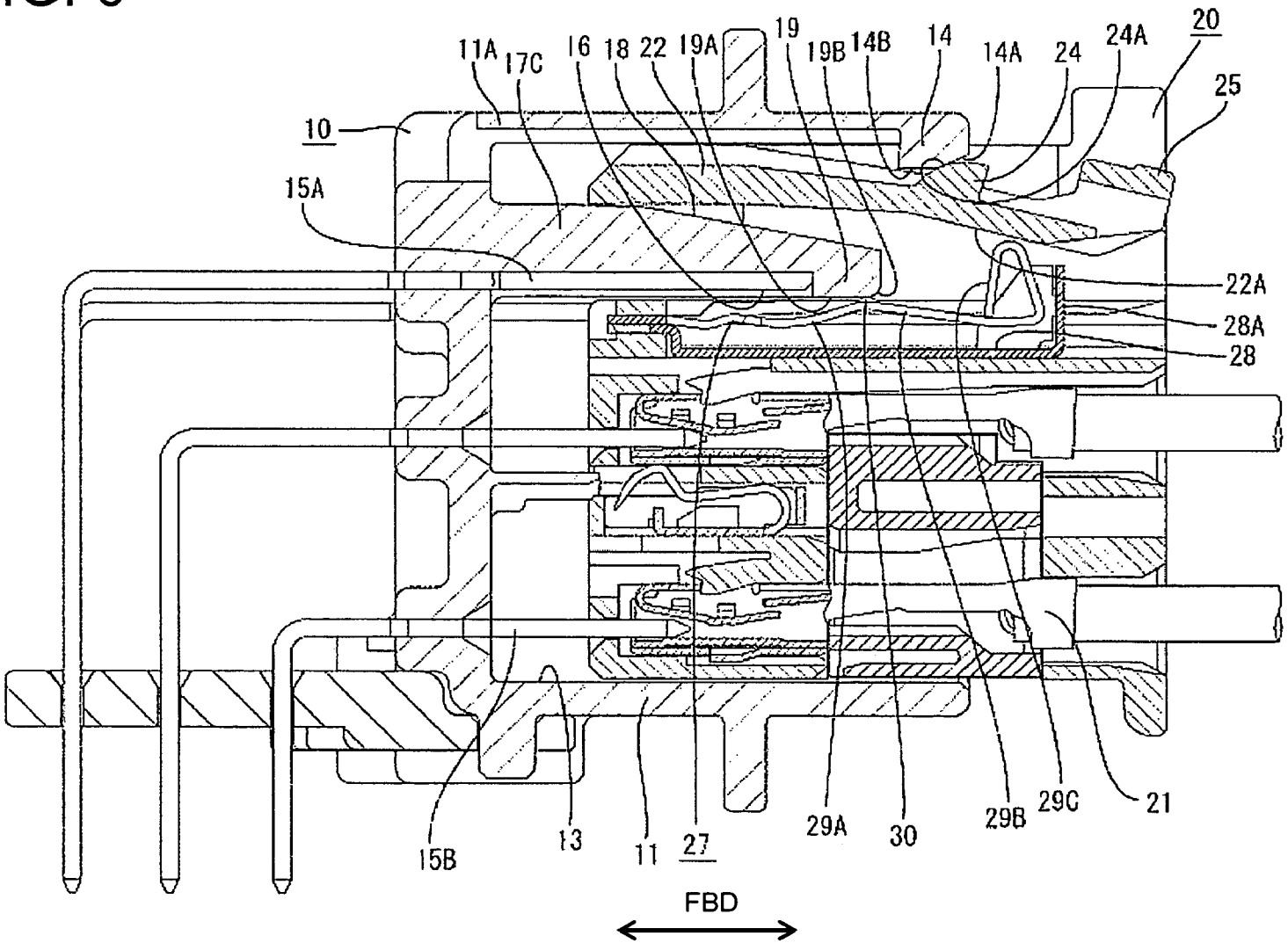
FIG. 6 is a side view in section showing a state where sliding contact portions are held in sliding contact with touching portions.

The front end of the lock arm 22 moves beyond the escaping portions 18 of the upper wall portions 17C of the reinforcing rib 17 as shown in FIG. 6. Thus, the sloped surface 24A of the projection 24 gradually contacts the slanted surface 14A of the engaging portion 14 so that the lock arm 22 deforms slightly down and in. Further, the round corner 19B of the slide contact 19 slides in contact with the outer surfaces of the respective resilient contact pieces 29 from the intermediate parts of the inclined portions 29A of the respective resilient contact pieces 29 in forward and backward directions FBD to the touching portions 30. At this time, a clearance exists between the pressing surface 22A and the pressable portions 29C of the shorting terminal 27 even though the lock arm 22 is deformed slightly. In other words, the resilient contact pieces 29 are pressed only by the slide contact 19 before being pressed by the lock arm 22.

The touching portions 30 advance from the front end to the rear edge of the slide contact surface 19A as the connecting operation proceeds while holding the outer surfaces thereof slide in contact with the slide contact surface 19A. Foreign matter could have entered through a small clearance between the rear opening of the female housing 20 and the protection wall 28A of the shorting terminal 27 to adhere to the touching portions 30 of the resilient contact pieces 29. However, the foreign matter is abraded off by the slide contact surface 19A. In this way, the outer surfaces of the touching portions 30 are cleaned from the front to the rear by the slide contact surface 19A to remove the foreign matter from the outer surfaces of the touching portions 30. Further, the lock arm 22 deforms more and more and the projection 24 passes the slanted surface 14A to reach the horizontal surface 14B.

Figure 7:
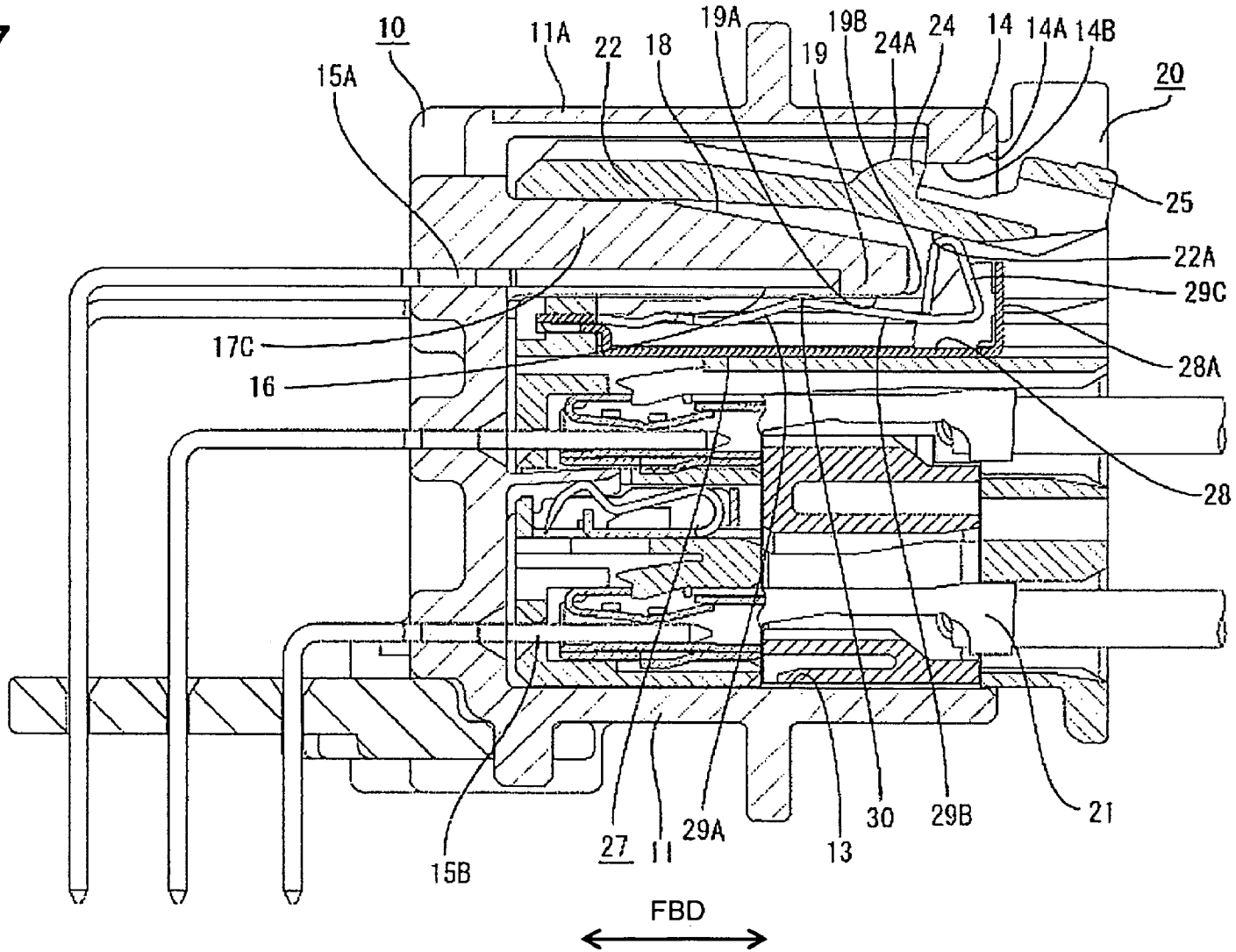
FIG. 7 is a side view in section showing a partly connected state of the two connector housings.

When the touching portions 30 pass over the slide contact surface 19A, the resilient contact pieces 29 try to restore resiliently by an amount of height difference between the slide contact surface 19A and the contact areas 16 on the lower surfaces of the detecting terminals 15A. Here, as shown in FIG. 7, the lock arm 22 is deformed by the projection 24 that has moved onto the engaging portion 14, and the top ends of the pressable portions 29C are in contact with the pressing surface 22A after the resilient contact pieces 29 resiliently restore a slight amount. The resilient contact pieces 29 are pressed by the lock arm 22 and cannot be restored any further. Thus, the touching portions 30 are kept distanced from the contact areas 16 without reaching the contact areas 16. In this way, the contact areas 16 of the detecting terminals 15A and the touching portions 30 are not in contact in a partly connected state of the two housings 10, 20 where the lock arm 22 is deformed.

Figure 8:
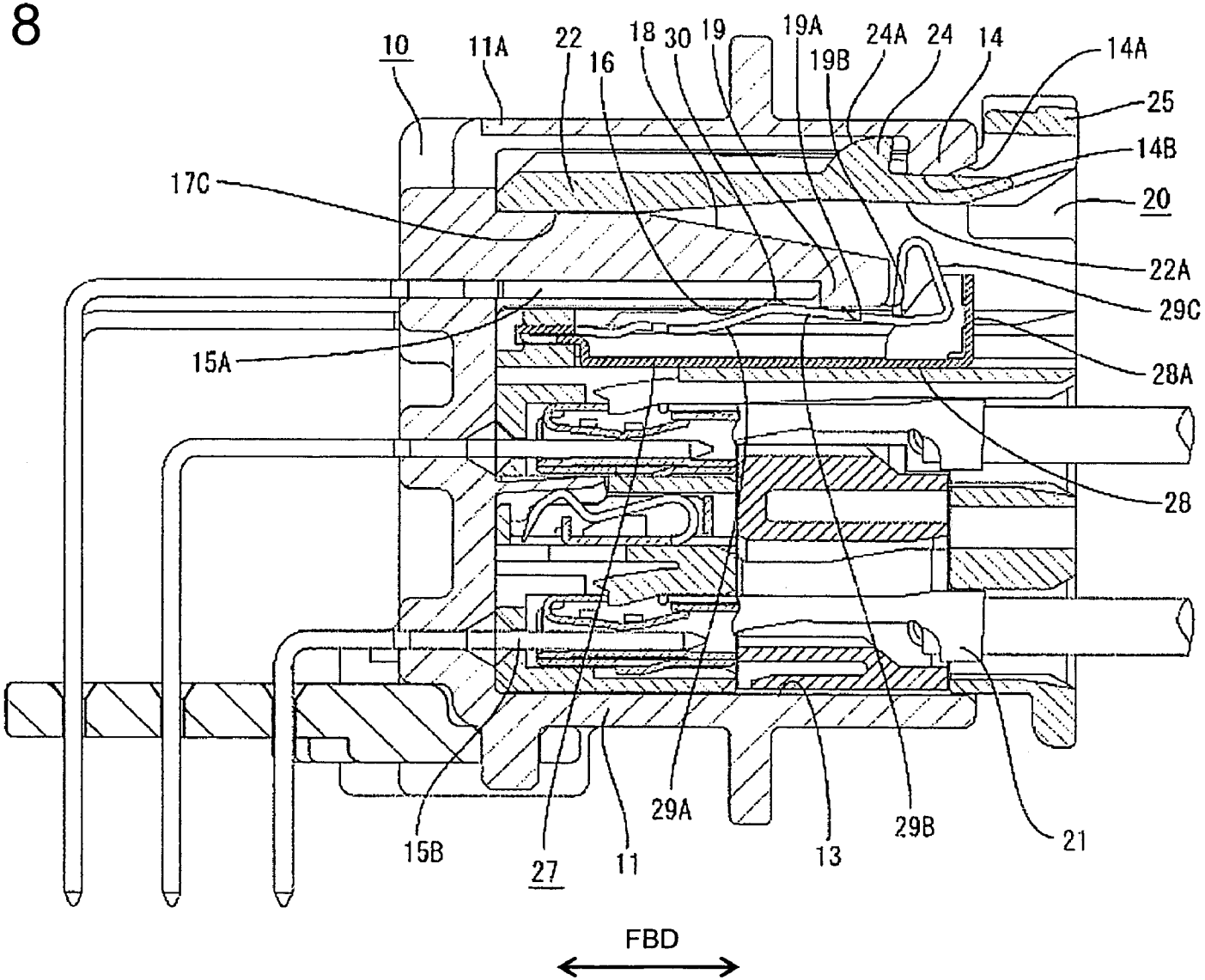
FIG. 8 is a side view in section showing a properly connected state of the two connector housings.

The lock arm 22 resiliently restores further when the projection 24 moves beyond the engaging portion 14. Thus, the projection 24 engages the engaging portion 14, as shown in FIG. 8, to lock the two housings 10, 20 in a properly connected state. Further, the restored lock arm 22 no longer presses the resilient contact pieces 29, and the resilient contact pieces 29 also restore resiliently. Thus, the touching portions 30, having the foreign matter removed therefrom, are held in contact with the contact portions 16 of the detecting terminals 15A. The contacts 16 of the detecting terminals 15A and the touching portions 30 are held in contact in the properly connected state of the two housings 10, 20 when the lock arm 22 is restored resiliently.

As described above, the detecting terminals 15A are not shorted with each other in the partly connected state of the two housings 10, 20, since the touching portions 30 of the shorting terminal 27 are not in contact with the contact portions 16 of the detecting terminals 15A. Thus, the partly connected state of the two housings 10, 20 can be detected. Further, the touching portions 30 are held in contact with the contact portions 16 to short the detecting terminals 15A in the properly connected state of the two housings 10, 20, and the properly connected state of the two housings 10, 20 can be detected.

As described above, the circuit board housing 10 includes the slide contacts 19 that are before the contact portions 16 of the detecting terminals 15A with respect to the connecting direction CD and can be brought into sliding contact with the touching portions 30 of the shorting terminals 27 during the connecting operation of the two housings 10, 20. Thus, the sliding contact of the slide contact portions 19 removes foreign matter from the touching portions 30 during the connecting operation of the two housings 10, 20. Therefore, extra steps are not needed remove foreign matter before the two housings 10, 20 are connected. The touching portions 30, having the foreign matter removed therefrom, contact with the contact areas 16 of the detecting terminals 15A. Thus, the reliability of the connection detecting function is ensured. Accordingly, foreign matter is removed easily from the touching portions 30 of the shorting terminals 27 to ensure the reliability of the connection detecting function.

The slide contacts 19 slide in contact with the touching portions 30 before the lock arms 22 press the shorting terminals 27 to assure reliable sliding contact.

The slide contacts 19 project farther down towards the touching portions 30 than the contacts 16 of the detecting terminals 15A. Thus, the contact of the touching portions 30 with the contacts 16 before coming into contact with the slide contact portions 19 is prevented.

The invention is not limited to the above described and illustrated embodiment. For example, the following embodiments are also embraced by the technical scope of the present invention as defined by the claims.

The slide contacts 19 are brought into sliding contact with the touching portions 30 before the lock arms 22 press the shorting terminals 27 in the foregoing embodiment. However, it is sufficient that slide contacts can be brought into contact with touching portions before being brought into contact with contact portions of detecting terminals according to the invention and the slide contacts may be brought into contact with the touching portions when the detecting terminals are pressed and displaced slightly by the lock arms.

The slide contacts 19 are at positions right before the contacts 16 of the detecting terminals 15A in the foregoing embodiment. However, they may be distanced forward from the contacts according to the invention.

The slide contacts 19 are at the leading ends of the reinforcing ribs 17 in the foregoing embodiment, but members including slide contacts may be provided in addition to the reinforcing ribs according to the invention.

The slide contacts 19 project down more towards the touching portions 30 than the contact areas 16 of the detecting terminals 15A. However, they may not necessarily project from the contact portions, i.e. the slide contact surfaces and the contacts may be at the same height according to the invention.

Although the lock arms 22 are cantilevers in the foregoing embodiment, the invention is also applicable to seesaw-shaped lock arms.

The slide contact surfaces 19A slide in contact with the touching portions 30 in the foregoing embodiment. Metal plates or plates made by rigid or hard material may be stuck to the slide contact surfaces or the slide contacts themselves may be made of, e.g. metal or abrasive blocks. Then, the metal surfaces contact the outer surfaces of the touching portions to obtain a so-called wiping effect, whereby oxide films or the like can be removed and the touching portions can be held in contact in a satisfactory manner.

What is claimed is:

1. A connector, comprising:

a housing having an open front end for receiving a mating housing along a connecting direction, a detecting terminal in the housing having a contact area prevented from contacting a touching portion of a mating detecting terminal in the mating housing in a partly connected state of the housing with the mating housing, and being able to contact with the touching portion when the housing is connected properly with the mating housing whereby partial connection of the housing with the mating housing is detected by the detecting terminal not being electrically connected to the mating detecting terminal, and proper connection of the housing and the mating housing being detected by electrical connection of the detecting terminal with the mating detecting terminal, wherein a slide contact provided in the housing between the detecting terminal and the open front of the housing, the slide contact being aligned with the contact area of the detecting terminal along the connecting direction so that the contact area achieves sliding contact with the touching portion during a connecting operation of the housing with the mating housing.

2. The connector of claim 1, wherein the slide contact projects more toward the touching portion than the contact area of the detecting terminal.

3. The connector of claim 1, wherein the housing comprises at least one reinforcing rib in proximity to the detecting terminal, the reinforcing rib projecting more forward than the detecting terminal along the connecting direction.

4. The connector of claim 3, wherein the reinforcing rib includes: a plate extending substantially along the detecting terminal, at least one first wall projecting from the plate on a side of the detecting terminal, and at least one second wall projecting from the plate on a side substantially opposite the detecting terminal.

5. The connector of claim 3, wherein the slide contact is provided on the reinforcing rib.

6. A connector assembly, comprising:

a housing having an open front end;

a mating housing connectable into the open front end off the housing along a connecting direction;

a resiliently deformable mating detecting terminal in the mating housing, a touching portion being disposed on the mating detecting terminal;

a detecting terminal in the housing and configured for contacting a the touching portion of the mating detecting terminal when the housings are connected properly; and at least one slide contact in the housing between the front end of the housing and the contact portion of the detecting terminal, the slide contact being aligned with the contact portion of the detecting terminal along the connecting direction and configured for sliding contact with the touching portion before the touching portion contacts the contact portion during a connecting operation of the housings, whereby the slide contact removes foreign matter from the mating detecting terminal before the housings are connected properly.

7. The connector assembly of claim 6, further comprising a lock arm on the mating housing, the lock arm being deformed as the housings are being connected, and being restored resiliently when the housings are connected properly for locking the housings together, the lock arm being configured to press and deform the mating detecting terminal as the lock arm is deformed and the mating detecting terminal being restored resiliently as the lock arm resiliently restores.

8. The connector assembly of claim 7, wherein the detecting terminal is configured to be spaced from the touching portion of the mating detecting terminal (27) in the partly connected state of the housings (10, 20) when the lock arm is deformed to press the mating detecting terminal, and contacts the touching portion (30) in the properly connected state of the two housings where the lock arm is resiliently restored to free the mating detecting terminal from a pressed state.

9. The connector assembly of claim 8, wherein the slide contact portion is arranged at a position for contacting the touching portion before the lock arm presses the first detecting terminal in the process of connecting the two housings.

10. The connector assembly of claim 6, wherein the slide contact portion projects more toward the touching portion than the contact portion of the detecting terminal.

11. A method of assembling a connector assembly, comprising the following steps:

providing a housing with a detecting terminal therein;

providing a mating housing with a resiliently deformable mating detecting terminal therein at a position for contacting the detecting terminal only when the housing and the mating housing are connected properly;

initiating a connecting operation between the housing and the mating housing;

sliding a slide contact of the housing across the mating detecting terminal before the two housings are connected properly for removing foreign matter from the mating detecting terminal; and detecting that the two housings are connected properly by contact of the detecting terminal and the mating detecting terminal to establish an electrical connection.

* * * * *